US006315471B1

(12) United States Patent
Hsieh et al.

(10) Patent No.: US 6,315,471 B1
(45) Date of Patent: Nov. 13, 2001

(54) APPARATUS FOR CONTROLLING RIBBON TENSION IN A THERMAL PRINTER

(75) Inventors: Chu-Cheng Hsieh, Hsinchu Hsien; Chuan-Yuan Chung, Hsinchu, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/417,330

(22) Filed: Oct. 13, 1999

(30) Foreign Application Priority Data

Aug. 21, 1999 (TW) ..... 88114314 A

(51) Int. Cl.[7] ..... B41J 33/16

(52) U.S. Cl. ..... 400/234; 400/223; 400/120.01; 347/172; 347/217

(58) Field of Search ..... 400/234, 120.02, 400/120.04, 223; 347/215, 172, 177, 178, 217

(56) References Cited

U.S. PATENT DOCUMENTS 4,661,826 * 4/1987 Saitou ..... 400/234
4,788,558 * 11/1988 Caldwell et al. ..... 400/234
6,010,258 * 1/2000 Tomita et al. ..... 400/120.04

FOREIGN PATENT DOCUMENTS 6-312568-A * 11/1994 (JP) .
8-2078-A * 1/1996 (JP) .
63-4984-A * 1/1988 (JP) ..... 400/234
5-58014-A * 3/1993 (JP) ..... 400/234

* cited by examiner

*Primary Examiner*—Daniel J. Colilla
(74) *Attorney, Agent, or Firm*—Jiawei Huang; J. C. Patents

(57) ABSTRACT

The invention described a thermal printer. The thermal printer has a supply reel, a take-up and a pair of motors. Each motor connects with the supply reel and the take-up reel, respectively. A detecting apparatus detects ribbon and the reel parameters while initializing the thermal printer. A memory stores a transforming table which can obtain the driving pulse width of each motor from a radius of the supply reel, a radius of the take-up reel and the ribbon tension. A control apparatus drive each motor with different pulse width according to parameters detected by the detecting apparatus and the transforming table. A thermal print head performs a printing process.

23 Claims, 4 Drawing Sheets

APPARATUS FOR CONTROLLING RIBBON TENSION IN A THERMAL PRINTER

CROSS-REFERENCE TO RELATED APPLICATION

This application claims the priority benefit of Taiwan application serial no. 88114314, filed Aug. 21, 1999, the full disclosure of which is incorporated herein by reference.

BACKGROUND OF THE INVENTION

1. Field of Invention

The present invention relates to an apparatus for controlling ribbon tension and a method for controlling the same. More particularly, the present invention relates to an apparatus for controlling ribbon tension in a thermal printer and a method for controlling the same.

2. Description of Related Art

In a thermal printer, a ribbon is used as a medium for transferring image. To obtain high print quality, a uniform ribbon tension should be maintained during the printing process. If ribbon tension is too low in the printing process, ribbon tension cannot lead the ribbon forward; the ribbon may even become slack, resulting in a torn ribbon by mechanism. If ribbon tension is too high, the ribbon may wrinkle and lower the print quality, and the ribbon may be deformed.

In general, the ribbon is unwound from a supply reel and collected on a take-up reel. The take-up reel in the thermal printer is usually driven by a step motor or a direct current motor, which provides a constant torque. The supply reel is not connected to a motor; thus, ribbon tension on the supply reel is only maintained by the frictional force between the supply reel and the ribbon. During the printing process, for a constant torque provided by the motor connected to the take-up reel, ribbon tension is governed by the equation:

$$\text{tension}=\text{torque}/\text{radius of take-up reel}$$

Consequently, ribbon tension is varied during the operation of the thermal printer by a change in the radius of the take-up reel.

Furthermore, to improve the print quality, the thermal print head is usually directly in contact with the ribbon during the printing process; thus, the frictional force between the thermal print head and the ribbon and the frictional force between the ribbon and the paper are both tremendously increased. Ribbon tension is also needed to be boosted up.

In addition, different functions are performed by the ribbon during the operation of the thermal printer, and these functions are achieved by controlling ribbon tension and the direction in which the ribbon moves. For example, in the preparation process, the ribbon should lead the paper into an engagement position between the capstan roller and the pinch roller. During the printing process, the ribbon should overcome the friction between the ribbon and the thermal print head and the friction between the ribbon and the paper. After a certain color panel is printed, the ribbon should run reversely to conduct the paper back into the back-feed path smoothly.

In U.S. Pat. No. 5,138,335, a spring is directly in contact with the supply reel and the take-up reel to control ribbon tension. In U.S. Pat. No. 5,529,410, ribbon tension is controlled by using pulse width of the motor connected to the take-up reel; thus, ribbon tension on the take-up reel is maintained uniform during the printing process. However, the structures in these patents mentioned above are complex, and their operations obviously do not satisfy the extra functions performed by nowaday thermal printing system.

SUMMARY OF THE INVENTION

The invention provides an apparatus for controlling ribbon tension in a thermal printer and a method for controlling the same to obtain high print quality.

As embodied and broadly described herein, the invention provides a thermal printer. In the thermal printer, ribbon tension is maintained uniform during the printing process to obtain high print quality.

As embodied and broadly described herein, the invention provides an apparatus for controlling ribbon tension in a thermal printer. The apparatus includes a supply reel, a take-up reel and a pair of motors. Each motor connects with the supply reel and the take-up reel, respectively. A detecting apparatus detects parameters of a ribbon and the reels while initializing the thermal printer. A control apparatus stores a transform relationship between a radius of the supply reel, a radius of the take-up reel, ribbon tension and pulse width of each motor.

In accordance with this invention, a thermal printer having a supply reel, a take-up and a pair of motors is provided. Each motor connects with the supply reel and the take-up reel, respectively. A detecting apparatus detects parameters of a ribbon and the reels, while initializing the thermal printer. A memory in the thermal printer stores a transforming table which was established beforehand. And the transforming table describes the relationship between a radius of the supply reel, a radius of the take-up reel, ribbon tension and pulse width of each motor. A control apparatus drives each motor with different pulse width according to parameters detected by the detecting apparatus and the transforming relationship. Hence, the tension of the ribbon either in take-up reel end or in supply reel end can be easily operated throughout the whole printing process. The front-end of paper also can be easily conducted into the moving path by the moving ribbon in back or forward direction.

The invention provides a method for controlling ribbon tension, which is applied in a thermal printer. The thermal printer includes a supply reel and a take-up reel, and each reel connects to a motor. A predetermined relationship table between ribbon tension and pulse width of each motor is established and stored in the thermal printer. While the thermal printer performs an initializing process, a radius of the supply reel and a radius of the take-up reel are calculated. Each motor is driven by different pulse width in accordance with the radius of the supply reel, the radius of the take-up reel and the transforming table.

In the invention, the initializing process is performed to obtain the radius of the supply reel and the radius of the take-up reel before the printing process. In accordance with the transforming table, the motor connecting with the supply reel and the motor connecting with the take-up reel are respectively driven by different pulse widths to obtain different ribbon tension during processes such as the preparation process, the printing process or the overprinting process. Additionally, the direction in which the ribbon moves can be changed during the above-mentioned processes.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
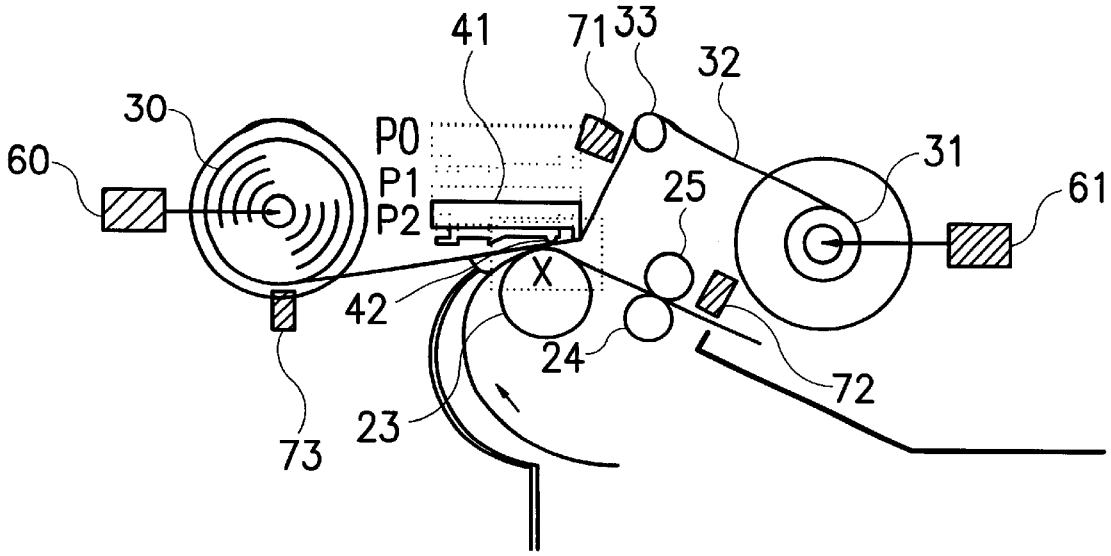
FIG. 1 is a schematic, cross-section view of a thermal printer according to the invention.

FIG. 1 is a schematic, cross-section view of a thermal printer according to one preferred embodiment of this invention.

Referring to FIG. 1, a ribbon 32 is unwound from a supply reel 30 and fed along a thermal print head 41, a printing region X, a ribbon sensor 71 and an idle roller 33 before being collected on a take-up reel 31. The ribbon sensor 71 is for detecting usage of the ribbon 32 and a number of the used color panels; moreover, the velocity of the ribbon 32 is also detected by the ribbon sensor 71 with indicium on the ribbon 32. A reel sensor 73 is positioned on the rim of the supply reel 30 to detect an angular velocity of the supply reel 30; thus, a radius of the supply reel 30 is calculated from the reel sensor 73 and the ribbon sensor 71. Motors 60, 61 are respectively connected to the supply reel 30 and the take-up reel 31.

A platen roller 23 is positioned under the printing region X. The platen roller 23 endures a pressure which is applied on a paper 26 and the ribbon 32 by the thermal print head 41 during the printing process. The thermal print head 41 including plural heating elements 42 are positioned over the platen roller 23 for performing a printing process. An adequate peeling angle between the ribbon 32 and the paper 26 is caused by the idle roller 33. By the peeling angle, the frictional force between the ribbon 32 and the thermal print head 41 can be reduced; thus the ribbon 32 easily separates from the paper 26. Other components of the thermal printer are well known to those skilled in the art, so detailed description is omitted herein.

Figure 2:
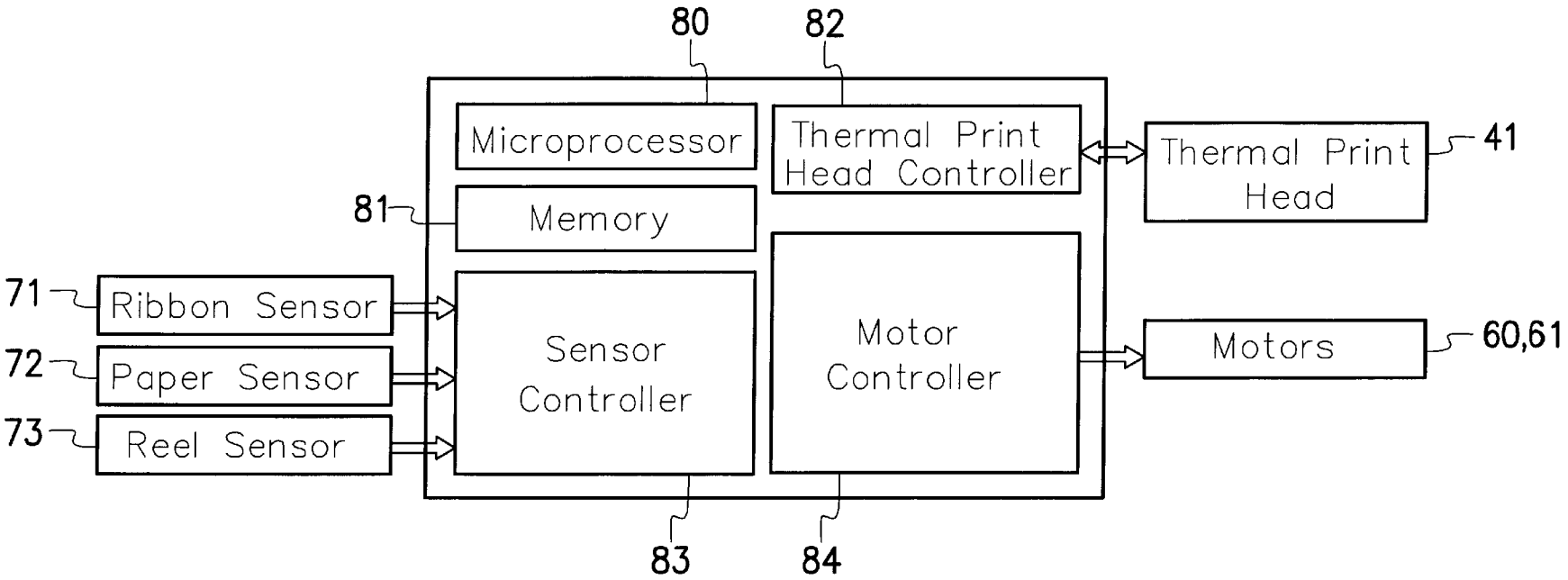
FIG. 2 is a schematic diagram of a control apparatus in the thermal printer according to the invention.

FIG. 2 is a schematic diagram of a control apparatus in the thermal printer.

Figure 3:
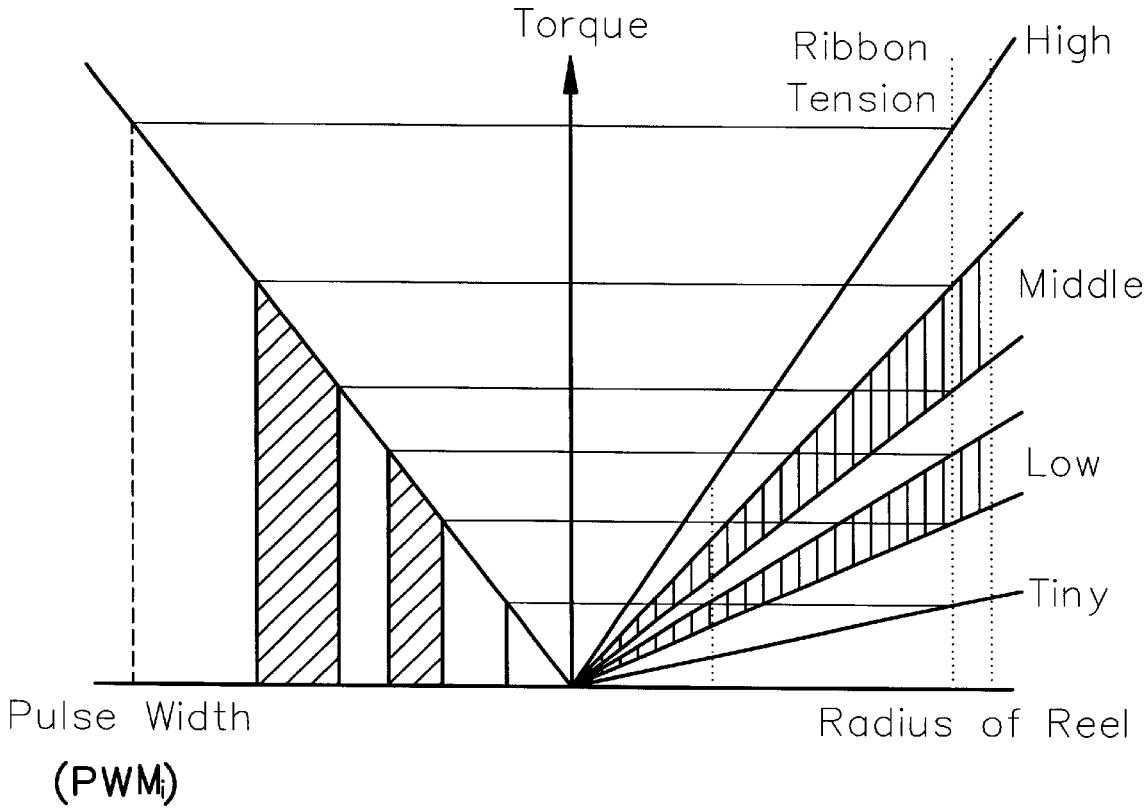
FIG. 3 is a diagram of a transforming relationship between ribbon tension and driving pulse width of each of the motors.

Referring to FIG. 2, a sensor controller 83 receives data provided by the ribbon sensor 71, the paper sensor 72 and the reel sensor 73, and transmits the data to a microprocessor 80. The microprocessor 80 calculates a radius of the supply reel 30 and a radius of the take-up reel 31 according to the data provided by the ribbon sensor 71 and the reel sensor 73. A memory 81 stores a pre-established transforming table between the driving pulse width of each of the motors 60, 61, the ribbon tension, the radius of the supply reel 30 and the radius of the take-up reel 31; the transforming table is as shown in FIG. 3. A motor controller 84 controls the motors 60, 61 according to the ribbon tension necessary for the operation of the thermal printer by referring to the transforming relationship stored in the memory 81. A thermal print head controller 82 controls the thermal print head 41 to perform the printing process.

When the thermal printer according to the invention is turned on, an initializing process is performed to calculate the radius of the supply reel and the radius of the take-up reel. The radius of the supply reel is calculated according to the data detected by the reel sensor and the ribbon sensor, and then the radius of the take-up reel also can be calculated. The radius of the supply reel and the radius of the take-up reel are calculated by the following equations.

the radius of the supply reel:

$$N_i pt=\pi(R_{out}^2-R_{si}^2)$$

$$R_{si}^2=R_{out}^2+N_i(pt/\pi) \qquad (A)$$

the radius of the take-up reel:

$$\pi(R_{out}^2-R_{si}^2)=\pi(R_{ti}^2-R_o^2)$$

$$R_{ti}^2=R_{out}^2+R_o^2-R_{si}^2 \qquad (B)$$

t: average thickness of ribbon, p: unit length of a color panel $N_i$: number of used color panels $R_{out}$: maximum radius of reel, $R_o$: minimum radius of reel (assume these of supply reel is the same to that of take-up reel)

$R_{si}$: radius of supply reel, $R_{ti}$: radius of take-up reel

If the electric power of the thermal printer is switched on at the beginning, the radius of the supply reel $R_{si}$ should be first calculated when the initializing process is performed. The radius of the supply reel $R_{si}$ is calculated by the following steps. The ribbon is reversed to the supply reel, and then the radius of the supply reel $R_{si}$ is obtained by the reel sensor and the ribbon sensor. By using equation (A), the number of used color panels $N_i$ is obtained, and the radius of the take-up reel $R_{ti}$ is obtained by equation (B).

After the radii of the supply reel and the take-up reel are obtained, a torque $\text{Torque}_S$ acting on the supply reel and a torque $\text{Torque}_T$ acting on the take-up reel are calculated by the following equations.

$$\text{Torque}_S=F_S\times R_{si}$$

$$\text{Torque}_T=F_T\times R_{ti}$$

$F_S$: ribbon tension on supply reel, $F_T$: ribbon tension on take-up reel

In accordance with the transforming table shown in FIG. 3, pulse width used to drive the motor connected to the supply reel and pulse width used to drive the motor connected to the take-up reel are obtained by the followings.

$$\text{Torque}_S=PWM_S$$

$$\text{Torque}_T=PWM_T$$

Figure 4:
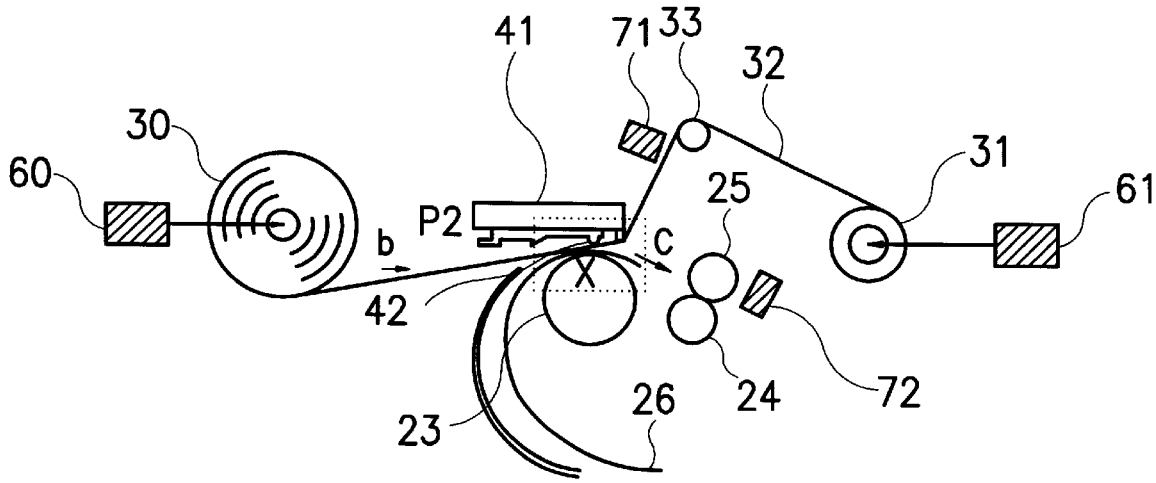
FIG. 4 is a schematic diagram showing a printing process performed by the thermal printer according to the invention.
Figure 5:
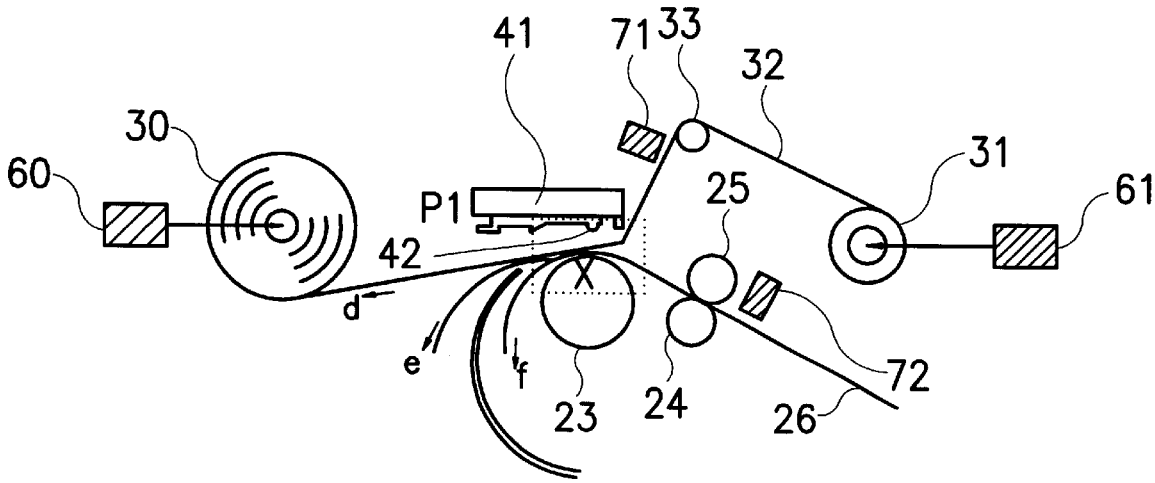
FIG. 5 is a schematic diagram showing the back-feed of the paper either in e or f direction guided by retracting ribbon performed by the thermal printer according to the invention.

FIG. 4 is a schematic diagram showing a printing process performed by the thermal printer according to the invention, and FIG. 5 is a schematic diagram showing the back-feed of the paper either in a direction e or f before an overprinting process performed by the thermal printer according to the invention.

Referring to FIGS. 1, 3, 4 and 5, the thermal print head 41 is located at a position P0, and an initializing process is performed while the thermal printer according to the invention is turned on. Ribbon tension on supply reel $F_S$ is greater than ribbon tension on take-up reel $F_T$; thus the ribbon 32 moves quickly along a direction d. The radius of the supply reel 30, the radius of the take-up reel 31 and the number of the used color panels are respectively obtained by the ribbon sensor 71 and the reel sensor 73.

Then, the thermal print head 41 moves to a "ready to print" position P1, and ribbon tension on supply reel $F_S$ is set about equal to ribbon tension on take-up reel $F_T$. As the paper feeds into a printing region X, the ribbon 32 moves slowly along a direction b by increasing the ribbon tension on the take-up reel FT and conveys the paper 26 along a direction c.

When arriving at the capstan roller 24 and the pinch roller 25, the paper 26 is engaged to perform register printing until finishing the whole printing process. When the paper 26 is engaged in position, the ribbon tension on the take-up reel $F_T$ is set more than the ribbon tension on the supply reel $F_S$, and the ribbon sensor 71 starts to search the right color panel which is going to be printed. After obtaining the right color panel, ribbon tension on take-up reel $F_T$ is set about equal to ribbon tension on supply reel $F_S$; thus, the ribbon 32 stops.

Then, a printing process is performed. During the printing process, the thermal print head 41 shifts to a position P2, and the capstan roller 24 rotates clockwise to convey the paper 26 along the direction c. Moreover, the thermal print head 41 presses the ribbon 32 and the paper 26 closely against the platen roller 23. Meanwhile, ribbon tension on the take-up reel $F_T$ increases; thus, the ribbon 32 overcomes the frictional force between the ribbon 32 and the thermal print head 41 and the frictional force between the ribbon 32 and the paper 26 to slowly move along the direction b. The paper 26 is conveyed along the direction c by the capstan 24 and the ribbon 32 at the same time.

After one color is printed, the thermal print head 41 shifts to the position P1 and the capstan roller 24 rotates counterclockwise to feed the paper into a back path. Ribbon tension on supply reel $F_S$ increases and ribbon tension on take-up reel FT reduces; thus, the ribbon 32 moves along the direction d. The paper 26 is conveyed along a direction e by the ribbon 32 until the paper 26 is registered with the prior printed color. Then, the printing process is performed again to print another color.

After all colors are printed, ribbon tension on supply reel $F_S$ and ribbon tension on take-up reel $F_T$ both reduces, and ribbon tension on supply reel $F_S$ is set to about equal to ribbon tension on take-up reel $F_T$ to stretch the ribbon 32 for preventing slack phenomena. The capstan roller 24 rotates clockwise to unload the paper 26.

During the above processes, the different functions performed by the ribbon are achieved by adjusting ribbon tension on supply reel and ribbon tension on take-up reel. The adjustment of ribbon tension on the supply reel and the adjustment of ribbon tension on the take-up reel are achieved by controlling torque respectively provided by the motors. The torque is respectively controlled by using different pulse width of each motor. By the radius of the supply reel and the radius of the take-up reel, which are obtained by the initializing process, and the transforming table shown in FIG. 3, the driving pulse width of each motor can be obtained.

Figure 6:
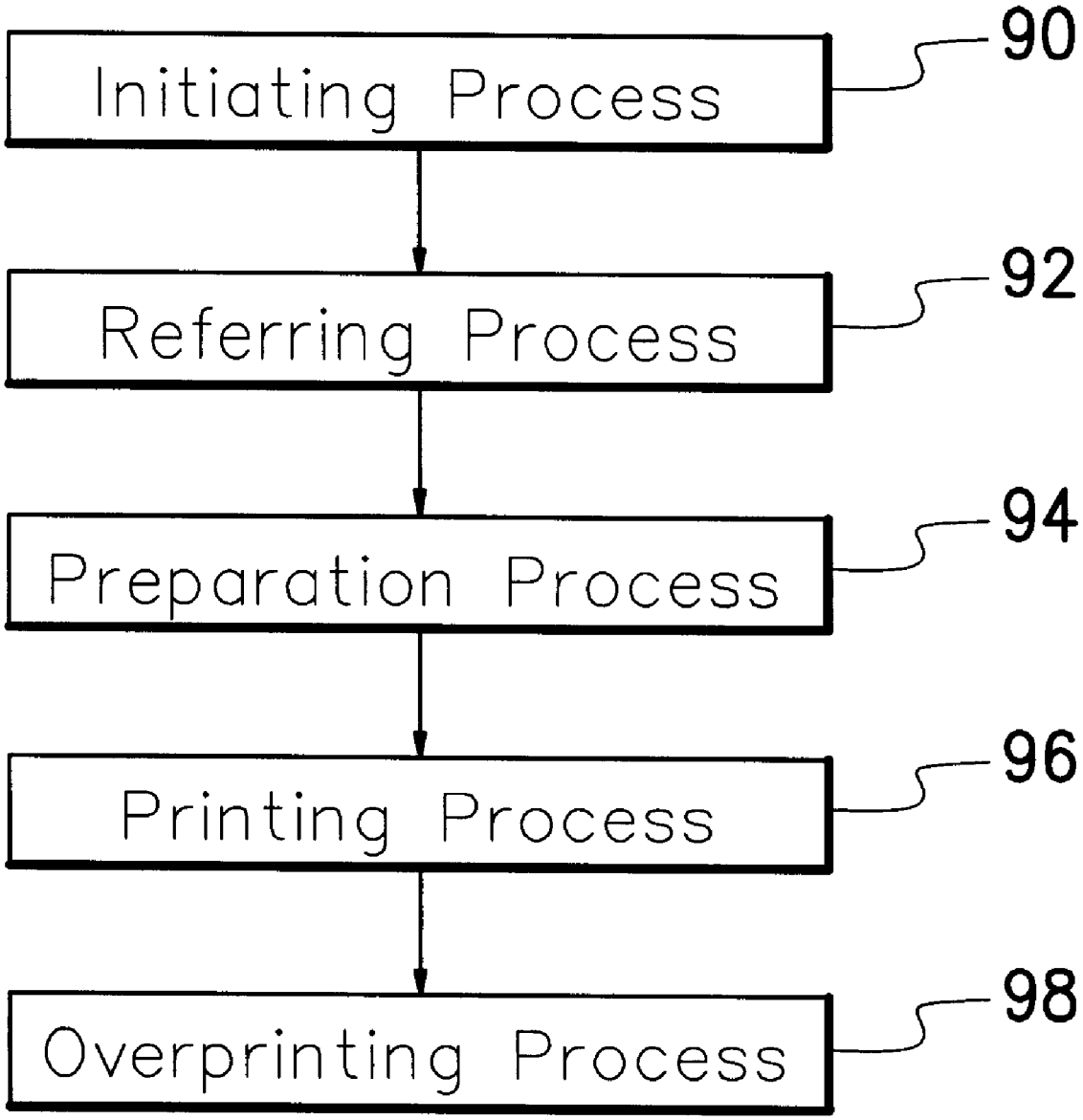
FIG. 6 is a flow diagram of the printing process performed by the thermal printer according to the invention.

FIG. 6 is a flow diagram of the printing process performed by the thermal printer according to the invention.

Referring to FIG. 6, an initializing process 90 is performed when the thermal printer is turned on; thus, the radius of the supply reel and the radius of the take-up reel are obtained. Then, a referring process 92 is performed to calculate pulse width used to drive the motor connects with the supply reel and pulse width used to drive the motor connects with the take-up reel are according to a pre-established transforming table between pulse width of each of the motors, ribbon tension, the radius of the supply reel and the radius of the take-up reel. A preparation process 94 is performed to set the thermal print head to P1 position to load a piece of paper into printing region X. Next, a printing process 96 is performed to print one color image on the paper. If another color is to be printed, the preparation process 94 is performed again and the paper is moved reversely to make registration with previous print image. Then, an overprinting process 98 is performed to print another color.

In the above processes, ribbon tension is changed by using different pulse width of each motor referred from the transforming table. As a result, the direction in which the ribbon moves can be changed and ribbon tension levels can be adjusted during the processes. The ribbon tension can be kept uniform by adjusting the driving pulse width and the radii of the take-up reel and the supply reel.

In the invention, the initializing process is performed to obtain the radius of the supply reel and the radius of the take-up reel before the printing process. In accordance with the transforming table, the motor connecting to the supply reel and the motor connecting to the take-up reel are respectively driven by different pulse widths to maintain uniform ribbon tension during the operation of the thermal printer such as the preparation process, the printing process or the overprinting process. Additionally, the direction in which the ribbon moves can be also changed during the mentioned processes.

According to the foregoing, the advantages of the invention include the following:

1. In the invention, the ribbon tension both the supply reel and the take-up reel can be maintained a uniform ribbon tension even in full or run-up position so that a high print quality is obtainable.
2. By the transforming table, and the supply reel and the take-up reel, which both connect with a motor, ribbon tension on the supply reel and ribbon tension on the take-up reel are controllable during the whole print operations.
3. Since the supply reel and the take-up reel are respectively connected with a motor, the direction in which the ribbon moves can be changed, and the ribbon can guide the paper during the operation.
4. During the operation of the thermal printer, such as in the preparation process, the printing process and the overprinting process, the motors connected with the supply reel and the take-up reel, respectively, are driven by different pulse widths. As a result, a uniform ribbon tension is maintained throughout the processes.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus for controlling ribbon tension, which apparatus is applied in a thermal printer, the apparatus for controlling ribbon tension comprising:

a pair of reels comprising a supply reel and a take-up reel;

a ribbon that is unwound from one reel and collected on another reel;

a pair of motors respectively connected to the reels;

a detecting apparatus that detects parameters of the ribbon and the reels while initializing the thermal printer; and a control apparatus that stores a transforming table between ribbon tension and pulse width of each motor such that each motor is driven by a different pulse width as a function of the parameters detected by the detecting apparatus and the transforming table.

2. The apparatus of claim 1, wherein the motors include direct current motors.

3. The apparatus of claim 1, wherein the detecting apparatus further comprises:

a ribbon sensor for detecting ribbon parameters; and a reel sensor detecting an angular velocity of the supply reel.

4. The apparatus of claim 1, wherein the control apparatus further comprises:

a motor controller controlling the motors.

5. A thermal printer, comprising:

a pair of reels comprising a supply reel and a take-up reel;

a ribbon that is unwound from one reel and collected on another reel;

a pair of motors respectively connected to the reels;

a capstan apparatus;

a detecting apparatus that detects parameters of the ribbon and the reels while initializing the thermal printer;

a memory that stores a transforming table between ribbon tension and pulse width of each motor;

a control apparatus that respectively drives the motors with different pulse widths as a function of the parameters detected by the detecting apparatus and the transforming table; and a thermal print head for performing a printing process.

6. The printer of claim 5, wherein the motors include direct current motors.

7. The printer of claim 5, wherein the detecting apparatus further comprises:

a ribbon sensor detecting ribbon parameters; and a reel sensor detecting an angular velocity of the supply reel.

8. The printer of claim 5, wherein the control apparatus further comprises:

a thermal print head controller controlling the thermal print head; and a motor controller driving the motors.

9. The printer of claim 5, wherein the capstan apparatus further comprises:

a capstan roller; and a pinch roller.

10. A method for controlling ribbon tension, which method is applied in a thermal printer comprising a supply reel and a take-up reel, each reel connecting to a motor, the method for controlling ribbon tension comprising the steps of:

establishing a transfer relationship between ribbon tension and pulse width of each motor, wherein a transforming table is stored in the thermal printer;

calculating a radius of the supply reel and a radius of the take-up reel while the thermal printer performs an initializing process; and controlling ribbon tension by driving the motors with different pulse widths, respectively, as a function of the radius of the supply reel, the radius of the take-up reel and the transforming table to control ribbon tension.

11. The method of claim 10, wherein the thermal printer further comprises:

a ribbon sensor detecting ribbon parameters; and a reel sensor detecting an angular velocity of the supply reel.

12. The method of claim 10, wherein the radius of the supply reel is calculated by detecting the angular velocity of the supply reel.

13. A method for controlling ribbon tension, which is applied in a thermal printer comprising a supply reel and a take-up reel, each reel connecting with a motor, with a memory storing a transforming table between ribbon tension and pulse width of each motor, the method for controlling ribbon tension comprising the steps of:

performing an initializing process to obtain a radius of the supply reel and a radius of the take-up reel;

obtaining a pulse width of each motor as a function of the radius of the supply reel, the radius of the take-up reel and the transforming table; and performing a printing process to print a color on a print medium by respectively driving each motor with the pulse width.

14. The method of claim 13, wherein a preparation process is performed before the printing process.

15. The method of claim 13, wherein an overprinting process is performed to print another color after the printing process.

16. The method of claim 13, wherein the print medium includes paper.

17. An apparatus for controlling ribbon tension, which apparatus is applied in a thermal printer, the apparatus for controlling ribbon tension comprising:

a pair of reels comprising a supply reel and a take-up reel;

a ribbon that is unwound from one reel and collected on another reel;

a pair of motors respectively connected to the reels;

a detecting apparatus, comprising a ribbon sensor and a reel sensor that respectively detect ribbon parameters and angular velocity of the supply reel while initializing the thermal printer; and a control apparatus that stores a transforming table between ribbon tension and pulse width of each motor, such that each motor is driven by a different pulse width as a function of the parameters detected by the detecting apparatus and the transforming table.

18. The apparatus of claim 17, wherein the motors include direct current motors.

19. The apparatus of claim 17, wherein the control apparatus further comprises a motor controller controlling the motors.

20. A thermal printer, comprising:

a pair of reels comprising a supply reel and a take-up reel;

a ribbon that is unwound from one reel and collected on another reel;

a pair of motors respectively connected to the reels;

a capstan apparatus;

a detecting apparatus comprising a ribbon sensor and a reel sensor that respectively detect parameters of the ribbon and angular velocity of the supply reel while initializing the thermal printer;

a memory that stores a transforming table between ribbon tension and pulse width of each motor;

a control apparatus that respectively drives the motors with different pulse widths as a function of the parameters detected by the detecting apparatus and the transforming table; and a thermal print head for performing a printing process.

21. The printer of claim 20, wherein the motors include direct current motors.

22. The printer of claim 20, wherein the control apparatus further comprises:

a thermal print head controller controlling the thermal print head; and a motor controller driving the motors.

23. The printer of claim 20, wherein the capstan apparatus further comprises:

a capstan roller; and a pinch roller.

* * * * *